United States Patent [19]

Carbone et al.

[11] Patent Number: 4,458,466

[45] Date of Patent: Jul. 10, 1984

[54] BLOCK OF IDENTICAL COMBINED BAG AND WRAPPING SHEET UNITS

[75] Inventors: George J. Carbone, West Nyack; Ronald J. Basso, Manhattan, both of N.Y.

[73] Assignee: Continental Extrusion Corporation, Garden City, N.Y.

[21] Appl. No.: 297,966

[22] Filed: Aug. 31, 1981

[51] Int. Cl.[3] ..... B67B 67/04; B67B 11/00; B65D 85/62

[52] U.S. Cl. ..... 53/390; 53/219; 221/63

[58] Field of Search ..... 53/461, 462, 469, 449, 53/219, 390; 206/554, 541, 542, 526, 223; 221/63; 248/99, 97, 100; 229/87 F

[56] References Cited

U.S. PATENT DOCUMENTS

| | | | |
|---|---|---|---|
| 460,472 | 9/1891 | Hitt | 206/526 X |
| 2,070,931 | 2/1937 | Taylor | 206/526 |
| 2,220,231 | 11/1940 | Gilfillan | 53/449 X |
| 2,720,766 | 10/1955 | Helburn | 206/541 X |
| 2,840,962 | 7/1958 | Stremke et al. | 53/390 X |
| 3,021,947 | 2/1962 | Sylvester et al. | 206/526 |
| 3,352,411 | 11/1967 | Schwarzkopf | 206/526 X |
| 3,353,661 | 11/1967 | Membrino | 206/526 |
| 4,201,299 | 5/1980 | Bumgarner et al. | 206/554 |
| 4,205,750 | 6/1980 | Dews | 53/449 X |
| 4,305,503 | 12/1981 | Membrino | 206/554 |

*Primary Examiner*—Horace M. Culver

*Attorney, Agent, or Firm*—Kirschstein, Kirschstein, Ottinger & Israel

[57] ABSTRACT

A combined bag and wrapping sheet unit provides both an arrangement and method for dispensing items that are to be wrapped and then inserted into a bag. The bag of the unit is flat and collapsed and has two broad panels attached to one another along at least a portion of their side edges, a closed bottom end and an open top end. A saddle section is provided which is a planar extension of one of said board panels and further a weakened zone between the saddle section and the panel of which it is an extension is provided. The wrapping sheet is flexible and is a planar extension of the saddle section. A weakened zone is provided between the wrapping sheet and the saddle section. Both the wrapping sheet and the bag are readily detachable from opposite sides of the saddle section. A number of registered, identically oriented bag and wrapping sheet units are attached to each other so as to form a single assembly block. The saddle sections of the individual units are attached to one another by a plurality of tack welds. The saddle section includes at least two holes thereon to allow said block to be positioned on a dispenser. The dispenser is formed with a bottom portion, two side portions and a top portion having at least two pins extending vertically upwardly therefrom for insertion through the holes in the saddle sections to thereby support the block of bag and wrapping sheet units on the dispenser.

4 Claims, 9 Drawing Figures

BLOCK OF IDENTICAL COMBINED BAG AND WRAPPING SHEET UNITS

BACKGROUND OF THE INVENTION

1. Field of the Invention

A combined bag and wrapping sheet, said wrapping sheet being a planar extension of said bag and being attached to said bag by a weakened zone so that said sheet can be readily detached from said bag and used to wrap an item of merchandise which thereafter is to be inserted in the bag.

2. Description of the Prior Art

When foodstuff is sold it is oftentimes desired to wrap same before it is inserted into a bag. Said wrapping helps to keep the foodstuff protected and fresh and is especially desirable when the foodstuff being sold is sliced meats or cheeses.

Heretofore when pre-wrapping foodstuff prior to inserting same into a bag, the store clerk had to reach for wrapping paper which was kept in stacks separate and apart from the bags, wrap the foodstuff and then put said wrapped foodstuff into a bag.

The above-described procedure for wrapping foodstuff had many drawbacks. Because the store clerk had to pick up the wrapping sheets and the bags from different places, the process of dispensing said foodstuff was not as quick as would be desired.

Further, the clerk would oftentimes accidentally grab more than one sheet from the stack of sheets which was wasteful of both time and money. Additionally, if the clerk's hands were greasy from slicing and handling the foodstuff, he would oftentimes get said grease on the wrapping sheet and the bag which was not satisfactory to the consumer.

Known in the prior art are two detachably interconnected bags in which foodstuffs can be placed. Although these detachably interconnected bags are satisfactory for the purpose for which they are intended, they do not provide means for pre-wrapping the foodstuffs prior to insertion into the bags and hence do not alleviate the aforementioned problems.

U.S. Pat. No. 3,286,826 discloses a package for removing and containing dog refuse which has in combination a fibrous rollable container and a stiff cardboard sheet which is usable as a scoop. The invention of '826 does not contain a wrapping sheet nor does it address itself to the problem of efficiently and neatly wrapping foodstuff items.

SUMMARY OF THE INVENTION

1. Objects of the Invention

It is an object of the present invention to provide a combined bag and wrapping sheet which avoids the disadvantages of prior art arrangements for wrapping foodstuff items.

Another object of the present invention is the provision of an improved arrangement for wrapping foodstuff items.

Yet a further object is to provide an inexpensive, easily manufacturable bag and wrapping sheet combination.

Still another object of the invention is to provide a bag and wrapping sheet combination which can be made using standard bagging machines.

An object of the invention is to provide a combined bag and wrapping sheet of the type described in which the bags and sheets are supportable on a dispenser.

Yet another object of the invention is to provide a combined one-piece bag and wrapping sheet of the type described in which the bag and wrapping sheet are easily separatable from one another.

An additional object of the invention is the provision of a single assembly block of combined bag and wrapping sheet units of the type described, the units including a middle segment for use with a dispenser.

A further object is the provision of a foodstuff wrapping arrangement of the type described wherein one always has the same number of sheets as bags.

Another object is to provide an efficient and inexpensive method for wrapping foodstuffs that are then inserted into a bag.

Other objects of the invention in part will be obvious and in part will be pointed out hereinafter.

2. Brief Description of the Invention

In keeping with these objects and others which will become apparent hereinafter, one feature of the invention resides, briefly stated, in a combined bag and wrapping sheet for wrapping an item of merchandise which thereafter is to be inserted into the bag.

The combined bag and wrapping sheet unit is characterized by the provision of a flexible flat collapsed bag having two broad panels, one of which is positioned behind and in registration with the other, a closed bottom end, an open top end. At least a portion of the side edges of the panels are attached to one another. The unit includes a single wrapping sheet which is a planar extension of one of said two broad panels and a means providing a weakened zone between said wrapping sheet and the broad panel of which it is a planar extension.

The wrapping sheet can be readily detached from the bag and then used to wrap a foodstuff item which thereafter is inserted into the readily detachable bag.

Another feature of the invention resides, briefly stated, in a combined bag and wrapping sheet unit which includes the afore-described flexible flat collapsed bag with two broad panels and which additionally has a saddle section which is a planar extension of one of said two broad panels. The bag also includes means for providing a weakened zone between the saddle section and the broad panel of which it is a planar extension. The bag and wrapping sheet combination additionally includes a flexible wrapping sheet which is a planar extension of the aforementioned saddle section and means providing a weakened zone between said wrapping sheet and said saddle section. The wrapping sheet and the bag are easily detachable from opposite sides of the saddle section.

Another feature of the invention resides in a single assembly block of identical superposed bag and wrapping sheet units. Each identical unit is characterized by having a single flexible flat collapsed bag with two broad panels, a closed bottom end and an open top end. One of said broad panels is positioned behind and in registration with the other broad panel. The broad panels of the bag are attached to one another along at least a portion of their side edges. A saddle section which is a planar extension of one of said two broad panels is included as is means providing a weakened zone between said saddle section and the broad panel of which it is a planar extension. Additionally, each unit includes a single flexible wrapping sheet which is a planar extension of said saddle section and means providing a weakened zone between said wrapping sheet and said saddle section of which it is a planar extension.

Each unit additionally has means positioned on its saddle section for attaching same to the other identical saddle sections of the block so as to form the single assembly block of identical units with bags superposed on bags and sheets superposed on sheets.

Another feature of the invention resides in a dispensing arrangement having a dispenser which contains thereon the aforementioned single assembly block of bag and wrapping sheet units. The saddle section of each unit is provided with at least two holes thereon for cooperating with the dispenser. The dispenser has a bottom portion which supports the dispenser on a horizontal surface, a top portion having at least two pins thereon for cooperating with holes of the saddle section and two sides which are attached to, and spaced away from, one another for supporting the bag and wrapping sheet of each unit. All the sheets hang down on one side of the dispenser and all of the flat collapsed bags hang down on the other side of the dispenser.

Another feature of the invention resides in the provision of a method for dispensing wrapped items of merchandise which uses the above-described dispenser and block of bag and wrapping sheet units. A user can easily detach the wrapping sheet from the unit and wrap an item of merchandise therein. The wrapped item of merchandise can then be inserted into the bag either before or after said bag is detached from the unit. The method permits the items to be wrapped and inserted into bags efficiently and inexpensively.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1A:
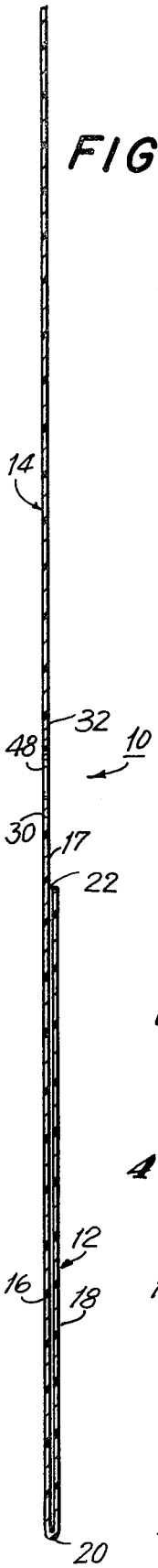
FIG. 1*a* is a sectional view taken substantially along line 1*a*—1*a* of FIG. 1.
Figure 1:
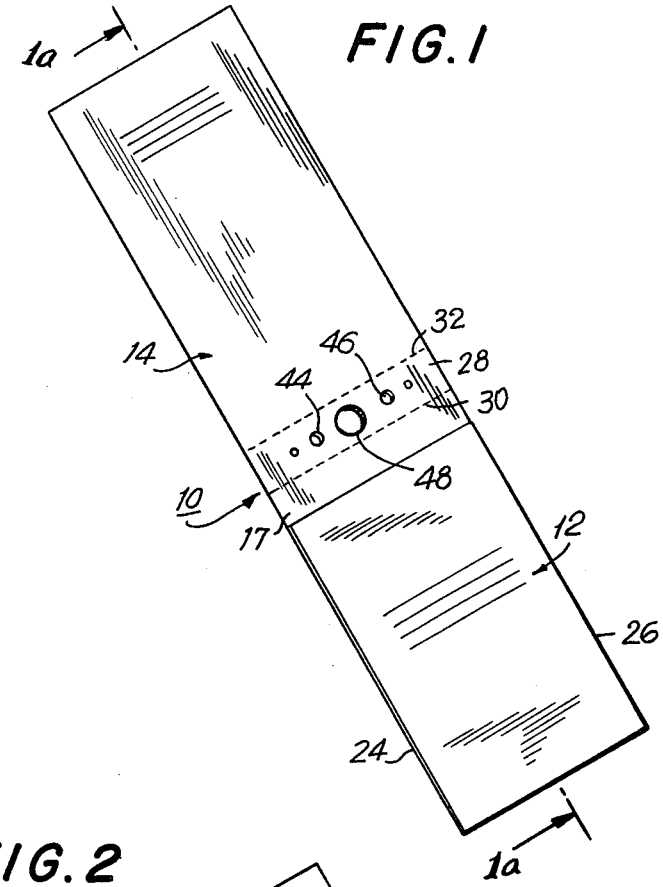
FIG. 1 is a perspective view of a single bag and wrapping unit of the present invention.

Referring now in detail to the drawings and more particularly to FIG. 1, the reference numeral 10 denotes a single bag and wrapping sheet unit of the present invention. Both the bag 12 and the wrapping sheet 14 are flexible and are preferably constituted of a translucent, textured, high density, polyethylene material.

Bag 12 has two broad panels 16 and 18, panel 18 being positioned behind, and in registration with, panel 16. The bag is provided with a bottom closed end 20 and a top open end or mouth 22. While a part of the unit 10, the bag 12 is collapsed and flat, i.e. the panels 16, 18 abut one another.

Panels 16 and 18 are attached to one another along, at least a portion of their side edges, and preferably are fully attached to one another along said side edges to form two unitary side bag seams 24 and 26, as shown in the drawings.

Wrapping sheet 14 may be a planar extension of, and in one-piece with, the panel 16 and means may be included providing a weakened zone between wrapping sheet 14 and panel 16. However, in a preferred embodiment, as shown in the drawings and as fully explained hereinafter, a saddle section 28 is included as part of unit 10 and said wrapping sheet, instead of being a planar extension of panel 16, is a planar extension of the saddle section, the panel 16, the saddle section 28 and the sheet 14 being in one-piece.

In the above-mentioned preferred embodiment of unit 10, saddle section 28 is a planar extension of panel 16. Means providing a first weakened linear zone 30 is located between saddle sections 28 and panel 16. Likewise, wrapping sheet 14 is a planar extension of saddle section 28 and means providing a second weakened linear zone 32 is located between saddle section 28 and wrapping sheet 14. First weakened zone 30 and second weakened zone 32 are substantially parallel to one another and in a preferred embodiment both weakened zones 30 and 32 are serrated portions of high density polyethylene. Other appropriate means for providing said weakened zones may be used, e.g. the thickness of the polyethylene may be reduced in these areas.

Preferably panel 16 is somewhat longer than panel 18 to thus make bag 12 a lip bag, i.e. including a lip 17. However, any other appropriate bag may be used and by way of example, bag 12 may be formed so as to be a self-locking bag. Additionally, in a preferred embodiment, bag 12 is a fold bottom bag but alternatively may have a gusseted bottom and/or gusseted sides.

Both bag 12 and wrapping sheet 14 are manufactured using standard bag-making machines which start with webs and provide high speed and low cost manufacture, thus permitting the finished unit 10 to be inexpensively sold.

Figure 2:
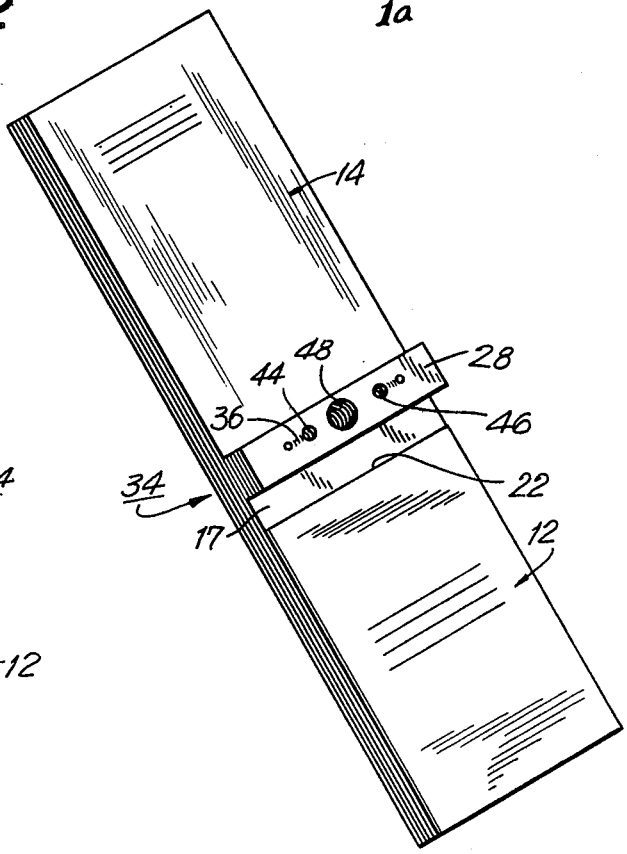
FIG. 2 is a perspective view of a single assembly block of identical bag and wrapping sheet units with some of the originally present units removed.

As best shown in FIG. 2, a number of identical registered stacked bag and wrapping sheet units are joined together in a single assembly block 34 of units. All of the units of block 34 are identical to one another. Said units are, except as detailed hereinafter, identical in structure to the above-described preferred embodiment of unit 10. When said units are so joined in a block 34, the saddle section 28 of each unit contains means thereon for attaching same to the other identical saddle units of the block. In a preferred embodiment, said means for attaching the saddle units to one another are a plurality of through tack welds 36, 38.

Figure 3:
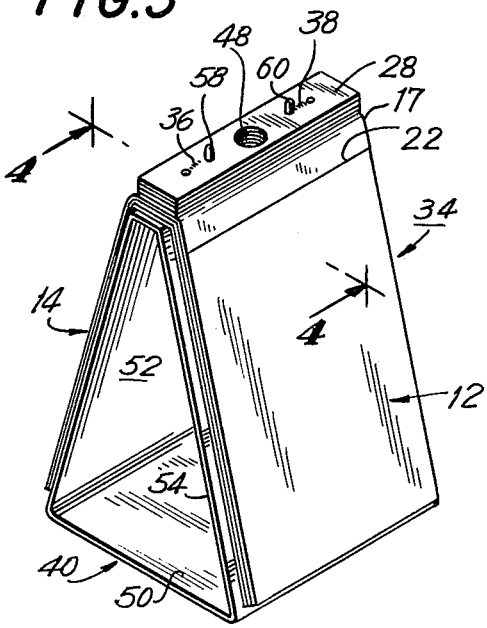
FIG. 3 is a perspective view of a single assembly block and a dispensing arrangement of the present invention with some of the originally present units removed.

Using block 34 and a conventional dispenser 40, a dispensing arrangement 43, best shown in FIG. 3, for dispensing sheets and wrapping units is provided.

The afore-described single assembly block 34 of units is formed with at least two bores 44, 46 through the saddle sections 28 of each unit 10. Bores 44 and 46 cooperate with dispenser 40 for supporting block 34 on same. Additionally, each saddle section may be formed with a third central bore 48 therein to permit the block 34, in an alternative arrangement, to be hung from a hook.

Dispenser 40 has a bottom portion 50 which supports said dispenser on any appropriate horizontal surface. Attached to bottom portion 50 are two upwardly converging dispenser side panels 52 and 54 which are of substantially similar size and shape and which are spaced apart from one another. Attached to said dispenser side portions, is a flattened top portion 56. Dispenser 40 in a preferred embodiment, is generally trapezoidally shaped in elevation. At least two pins 58 and 60 extend vertically upwardly from top section 56 for insertion through bores 44 and 46 to cooperate with same for holding block 34 on dispenser 40.

Figure 4:
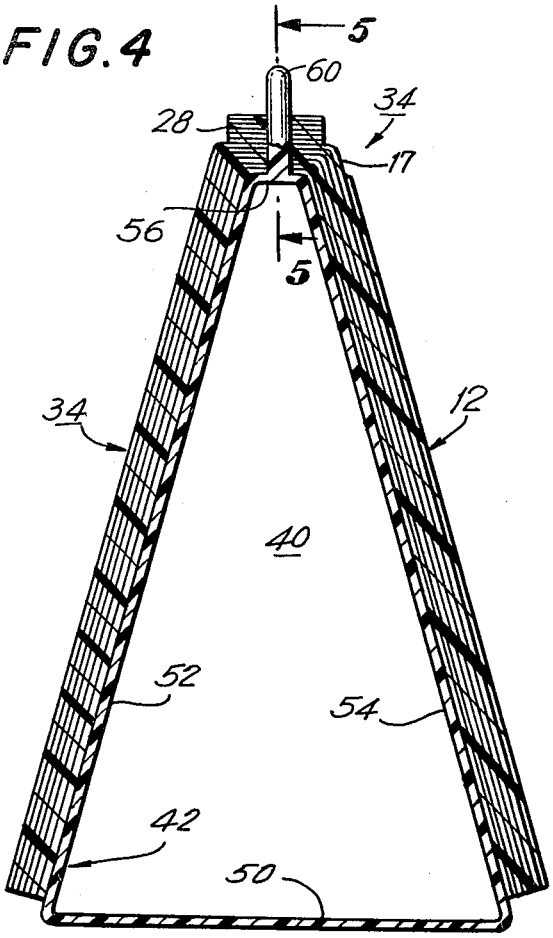
FIG. 4 is an enlarged sectional view taken substantially along line 4—4 of FIG. 3.

As best seen in FIGS. 2, 3 and 4 when the wrapping sheet 14 and bag 12 of each uppermost unit 10 are separated from said unit by stripping them at their associated weakened zones, the saddle section 28 remains on the dispenser 40 attached via tack welds 36 and 38 to the other saddle sections of the block 34.

Block 34 and dispenser 40 together provide a method for efficiently dispensing wrapped items of merchandise in bags. The block 34, due to its unitary assembly formation, is easily placed on dispenser 40 which holds said block so that the units 10 of the block are easily accessible to a user. Dispenser 40 is comparatively small and does not require much space.

Figure 6:
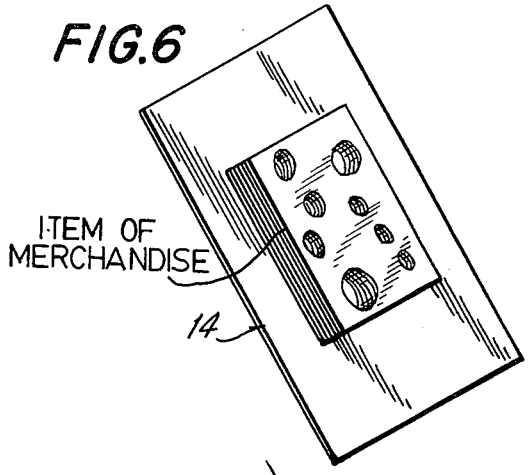
FIGS. 6, 7 and 8 are perspective schematic views showing a bag and wrapping sheet of the present invention as used in accordance with the method of the present invention.
Figure 7:
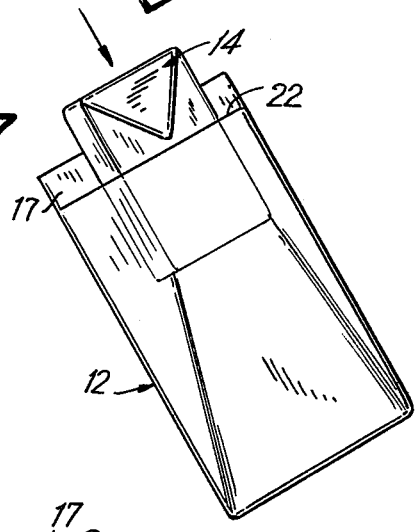

After block 34 is positioned on dispenser 40, when a user desires to wrap goods and then insert said wrapped goods in a bag, he first detaches wrapping sheet 14 from saddle section 28 at its associated weakened zone. The user can then wrap an item of merchandise as shown in FIG. 6 in said sheet 14. The wrapped merchandise can then be inserted into bag 12 as shown in FIG. 7, bag 12 being easily detachable from saddle section 28 at its associated weakened zone so as to provide a single closable bag containing therein the wrapped item of merchandise. Bag 12 may be detached from saddle section 28 either before or after the wrapped item is placed therein.

Figure 8:
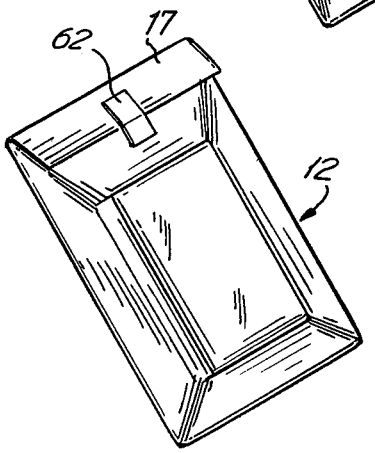
Figure 5:
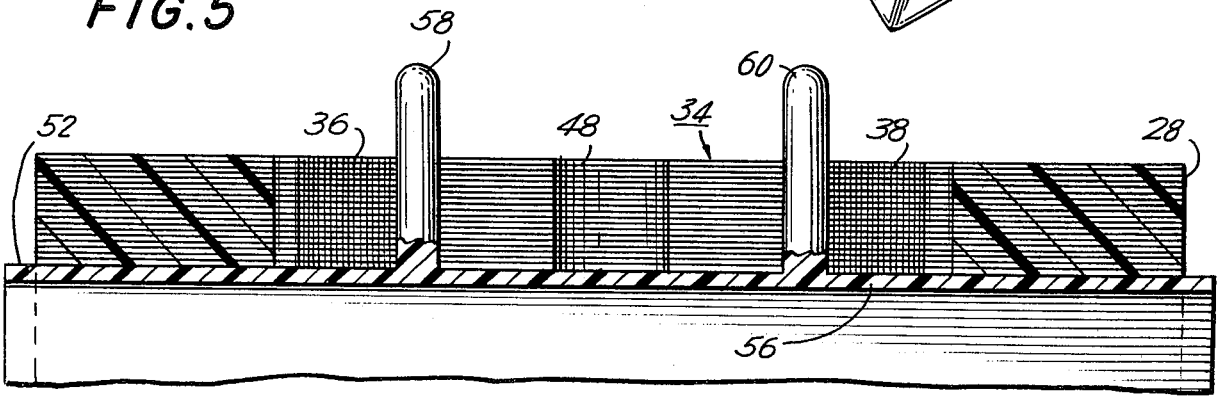
FIG. 5 is a sectional view taken substantially along line 5—5 of FIG. 4.

As heretofore mentioned, bag 12 in a preferred embodiment, is a lip bag and hence, as shown in FIG. 8, lip 17 may be folded over open mouth 22 to thus close the bag. As heretofore mentioned, the bag may include means thereon to make it self-sealing or, as shown in FIG. 8, other appropriate sealing means 62 such as adhesive tape, may be provided for sealing bag 12 after the lip 17 of panel 16 is folded over the mouth of the bag.

It will be unserstood that each of the elements described above, or two or more together, may also find a useful application in other types of constructions differing from the types described above.

While the invention has been illustrated and described as embodied in a multiplicity of bag and wrapping sheet units, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior air, fairly constitute essential characteristics of the generic or specific aspects of this invention and, therefore, such adaptations should and are intended to be comprehended within the meaning and range of equivalence of the following claims.

What is claimed as new and desired to be protected by Letters Patent, is set forth in the appended claims.

1. A block of bags and wrapping sheets which form a single assembly comprising a plurality of identical superposed registered units each constituted of a translucent, textured, high density, polyethylene sheet material, each unit including:

(A) a single flexible flat collapsed bag with:
- (i) a first broad panel,
- (ii) a second broad panel positioned behind, and in registration with, the first panel,
- (iii) a closed bottom end,
- (iv) an open top end, and
- (v) said first and said second sheets being attached to one another along at least a portion of their side edges to form a bag with an open mouth;

(B) a single saddle section at the mouth end of the bag and which is a planar extension of one of said panels of said bag;

(C) means providing a weakened zone between said saddle section and the panel of which it is a planar extension;

(D) a single flexible wrapping sheet which is on the side of said saddle section opposite from said bag and is a planar extension of said saddle section;

(E) means providing a weakened zone between said wrapping sheet and said saddle section of which it is a planar extension; and (F) means positioned on said saddle section for attaching same to the other identical saddle sections so as to form said single assembly block.

2. The block of claim 1, wherein the attaching means on the saddle section consists of a plurality of tack welds.

3. A dispensing arrangement with a block of superposed registered bags and wrapping sheets which form a single assembly thereon comprising:

(A) a plurality of identical units each constituted of a translucent, textured, high density, polyethylene sheet material each unit including:
- (i) a single flexible flat collapsed bag, each bag having:
  - (a) a first broad panel,
  - (b) a second broad panel positioned behind, and in registration with, the first panel,
  - (c) a closed bottom end,
  - (d) an open top end, and
  - (e) said first and said second sheets being attached to one another along at least a portion of their side edges to form a bag with an open mouth,
- (ii) a saddle section at the mouth end of the bag and which is a planar extension of one of said panels of said bag, the saddle section being formed with at least two holes thereon,
- (iii) the holes on each saddle section being in registration with the holes on the other saddle section,
- (iv) means providing weakened zone between said saddle section and said panel of which it is a planar extension,
- (v) a single flexible wrapping sheet which is on the side of said saddle section opposite from said bag and is a planar extension of said saddle section,
- (vi) means providing a weakened zone between said wrapping sheet and said saddle section of which it is a planar extension, (B) means positioned on said saddle section for attaching same to the other identical saddle sections so as to form said single assembly block, and (C) dispenser means for supporting said block of identical units, said dispenser means having:

(i) a bottom portion for supporting said dispenser means on a horizontal surface, (ii) two side panels attached to said bottom portion and being spaced away from one another for supporting the bags and wrapping sheets, and (iii) a top portion attached to said side panel, with at least two erect pins thereon for cooperating with the holes of the saddle sections.

4. The dispensing arrangement and single assembly block of claim 3, and additionally comprising means on each bag for selectively closing the top thereof.

* * * * *